US005461987A

United States Patent [19]

Nassar

[11] Patent Number: 5,461,987

[45] Date of Patent: Oct. 31, 1995

[54] SIDE ARM STRUCTURE OF A STEERING ARM ASSEMBLY HAVING AN UNDERCUT RADIUS

[75] Inventor: Rami V. Nassar, Chicago, Ill.

[73] Assignee: AMSTED Industries Incorporated, Chicago, Ill.

[21] Appl. No.: 276,563

[22] Filed: Jul. 18, 1994

[51] Int. Cl.[6] ..... B61F 5/50

[52] U.S. Cl. ..... 105/167; 105/168

[58] Field of Search ..... 105/165, 167, 105/168, 463, 1; 213/100, 152

[56] References Cited

U.S. PATENT DOCUMENTS 4,131,069 12/1978 List ..... 105/168
4,889,054 12/1989 List ..... 105/167
4,976,362 12/1990 Kaufhold ..... 213/152
5,224,428 7/1993 Wronkiewicz ..... 105/167

OTHER PUBLICATIONS

"*Stress Concentration Factors*" by R. E. Peterson, Willy & Sons, New York, 1974; pp. 83–86.

*Primary Examiner*—Robert J. Oberleitner
*Assistant Examiner*—Clifford T. Bartz
*Attorney, Agent, or Firm*—Edward J. Brosius; F. S. Gregorczyk; Thomas J. Schab

[57] ABSTRACT

A steering arm assembly for a railway truck has an undercut compound radius between the body portion and the longitudinal segment on of each side arm in order to decrease the stress intensity at this location, which resultantly provides increased flexural strength to the assembly while maintaining the clearance between the steering arm and truck components.

7 Claims, 3 Drawing Sheets

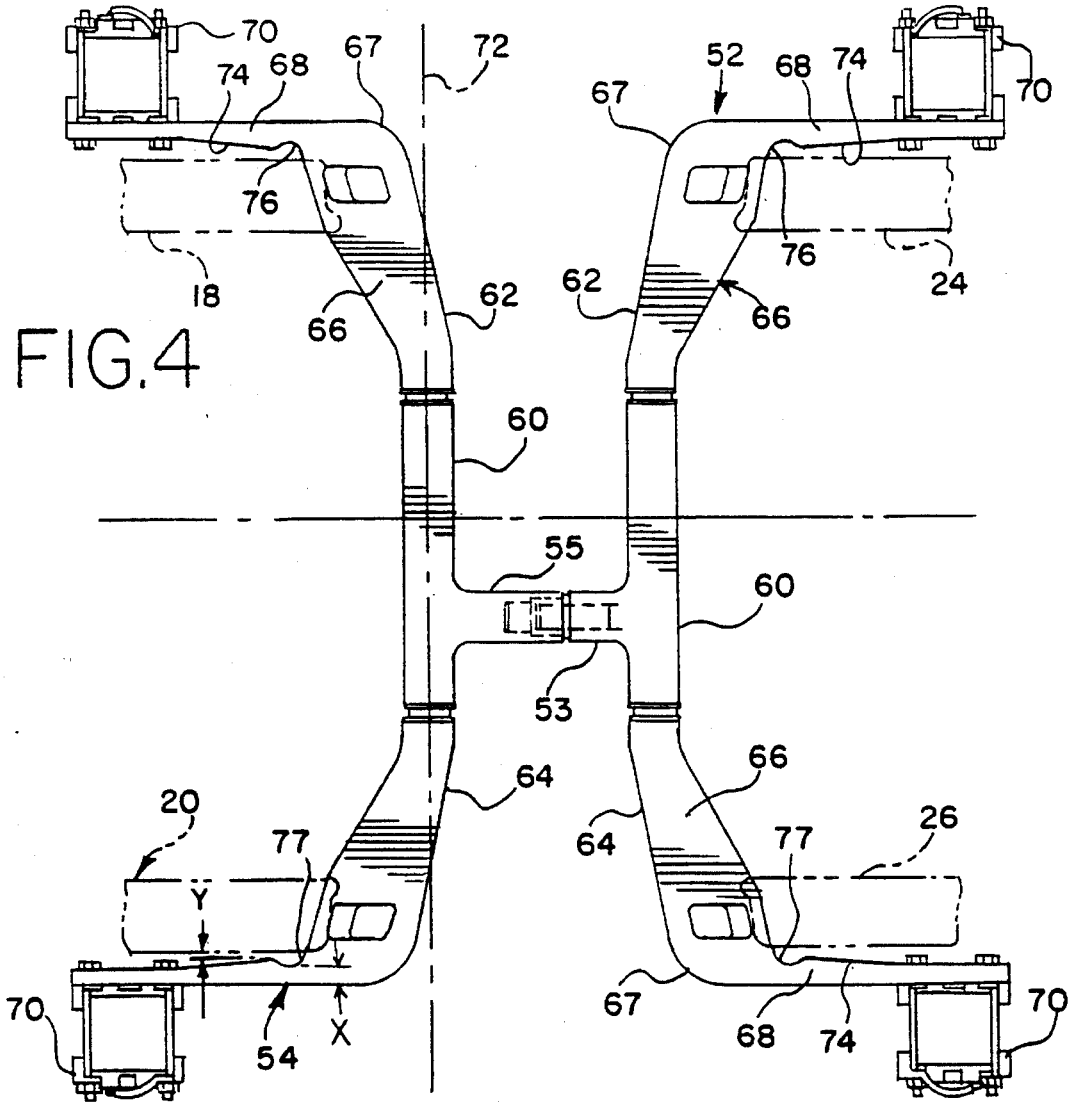
FIG.4
FIG.5
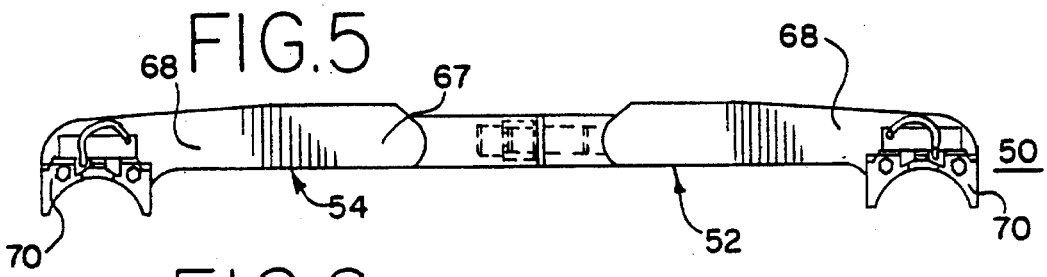
FIG.6
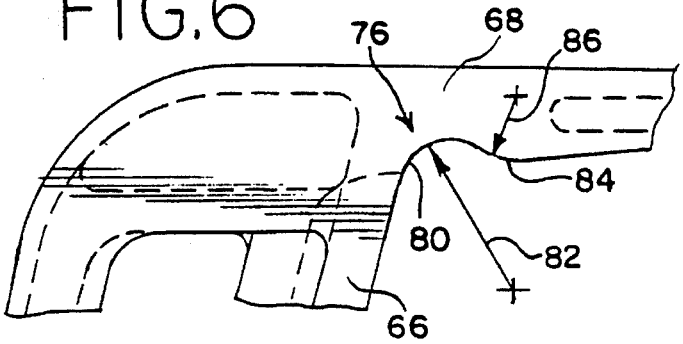

SIDE ARM STRUCTURE OF A STEERING ARM ASSEMBLY HAVING AN UNDERCUT RADIUS

BACKGROUND OF THE INVENTION

The present invention relates to steering arms for steerable or radial railway trucks. More specifically, the side arms of each of the U-shaped steering arm sub-assemblies which comprise the steerable truck assembly, are provided with an undercut radius to improve the flexural strength between the side arm body portion and the side arm longitudinal segment without encumbering or interfering with the wheel position or operation. The undercut radius allows conventional foundry production and finishing practices.

Side trucks or steering arms for a vehicle truck are utilized to control railroad car trucks, especially against hunting or lateral movement during radial travel around curves. The objective of any of the radial trucks is adjustment of the axles, bolster and sideframe motion to accommodate radial movement around curves for relief of the lading from the shocks and jars incident to the contact between rails and wheel flanges.

Recent developments in steering arms for articulated railway trucks have concentrated on problems of lateral restraint and yaw flexibility between the two wheelsets of a truck in order to prevent high speed hunting. Changes in the steering arm structures for self-steering wheelsets are illustrated in U.S. Pat. No. 4,781,124 to List. However, one shortfall of that design is that the side arms of the steering arm structures project generally normal to the steering arm cross-beam, and are in close proximity to the wheel, thereby minimizing the available space for other truck components. As a consequence, the intersection between the steering arm assembly cross-beam and side arm is approximately a right angle. In operation, there is a repeated flexural load placed upon all joint intersections of these modern steering arm structures, and as noted, the clearances between the wheel and steering arm are minimal. The wheel, sideframe and bolster clearances, as well as the steering arm sizes, have combined to preclude or limit development of a stronger junctional relationship between the side arms and cross-beam, and of the side arms themselves. Although the addition of greater mass to a joint, or using a larger and smoother radius in a corner junction would act to increase the strength of the particular junction by dispersing the stresses over a greater area or mass, these alternatives are not readily available in many modern steering arm apparatus with the above-noted clearance constraints. A discussion of alternatives for increasing strength of intersecting arms or segments is provided in *Stress Concentration Factors*, by R. E. Peterson, John Wiley and Sons, 1974. It is noted that although circular fillets are utilized for ease of machining and drafting, they do not provide for minimum stress concentration. (See pages 80–83).

The development of stronger steering arm component junctions would allow tighter control of both the lateral restraint and yaw flexibility of the truck wheelsets and railcar, and provide greater control of high speed truck hunting. Working within the constraints of minimal clearances, a recent steering arm component junction was provided for in U.S. Pat. No. 5,224,428 to Wronkiewicz, assigned to American Steel Foundries, Inc. of Chicago, Ill. who is also co-owner of the present invention. In that steering arm assembly, the corner junctions of each side arm were provided with a compound fillet in the form of an elliptical radius. The compound fillet increased the flexural strength of each side arm over the circular radius, while simultaneously maintaining the necessary clearances between the steering arm and truck components.

However, producing a complicated compound fillet like the elliptical radius requires special quality assurances to maintain near-excellent steel quality so that surface or internal defects have no interplay with the formation of fatigue cracks. Using conventional foundry casting practices to maintain that level of consistent quality proves nearly impossible, and for this reason other methods for increasing the side arm fatigue life were explored. One successful method discovered was to increase the shot peening intensity during finishing, and this increase was achieved with the tumble blast method. However, this method precluded the use of grade B cast steels because they were found to be too soft for peening at the higher intensity. A second method investigated comprised tempering and quenching the casting, and although this method appeared favorable, the physical field distances between the tempering ovens and the quench tanks made this method to be unfeasible. Structural changes to the steering arm were also investigated, leading to the present invention.

SUMMARY OF THE INVENTION

The present invention provides an improved shoulder structure for a truck steering-arm sub-assembly at each junction of the sub-assembly side arm components. More specifically, the shoulder of each side arm is provided with an undercut circular radius on the inner sidewall. Although more metallic mass is removed from this critical stress area, a larger arc segment is provided with an undercut radius, thereby improving the flexural strength of the steering arm assembly and particularly, the flexural strength at the junction between the side arm body portion and the sidearm longitudinal segment. The undercut radius provides a smoother transition between the body portion and the longitudinal segment elements of the side arm, thereby reducing the stress intensity at this location. The increase in bending or flexural strength is accomplished within the minimal available space between the steering arm and wheel without broad changes in the structure of the steering arm assembly and without disabling normal operation of the steering arm or wheel. The resultant increase in flexural strength allows the side arm to be cycled over 9 million cycles without failure and without increasing the steering assembly weight. Furthermore, by providing a larger radius at the junction location, minor foundry defects can now be tolerated, thereby reducing the degree of casting finishing.

BRIEF DESCRIPTION OF THE DRAWING

In the several figures of the Drawing like reference numbers refer to like elements, and in the drawing;

FIG. 4 is a plan view of a steering arm assembly of the present invention;

FIG. 5 is an elevational view of the steering arm assembly of FIG. 4;

FIG. 6 is an enlarged view of a corner junction between the side arm body portion and the longitudinal segment which incoporates the undercut radius of the present invention;

DETAILED DESCRIPTION OF THE PREFERRED EMBODIMENT

Figure 1:
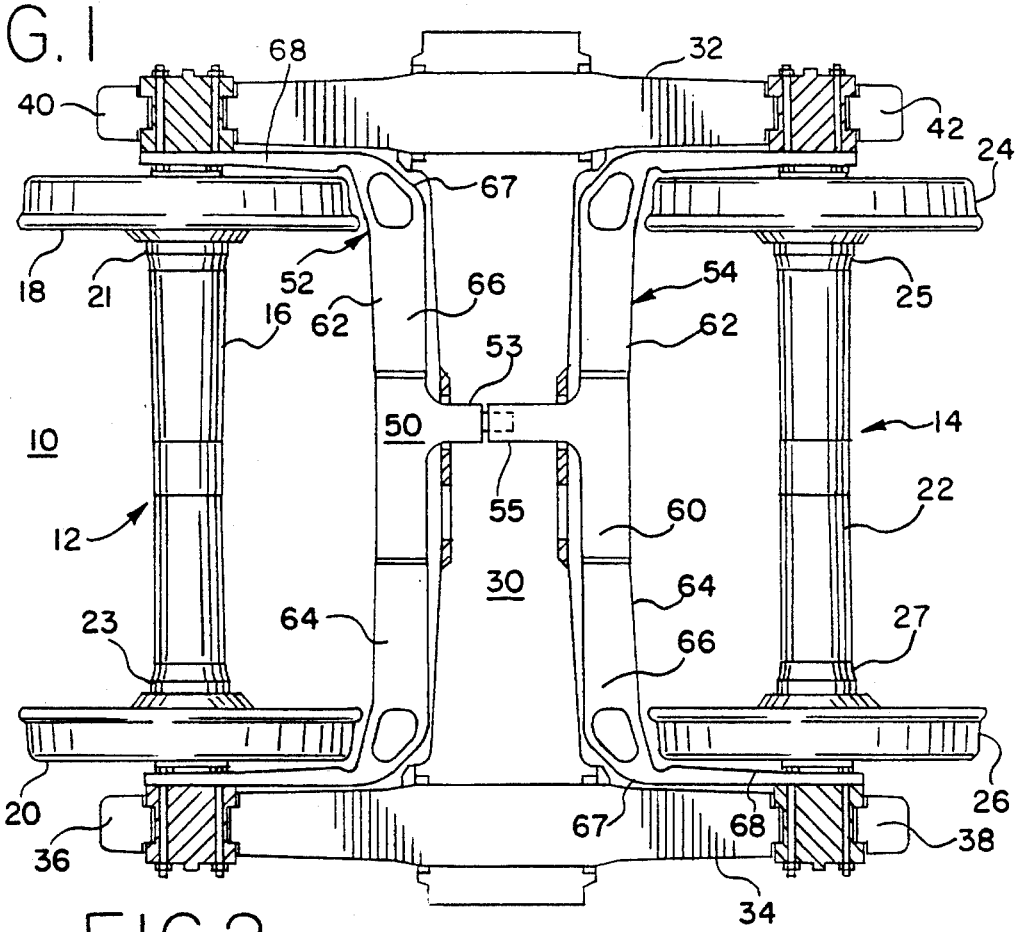
FIG. 1 is a plan view of an illustrative railway truck and steering arm assembly.
Figure 2:
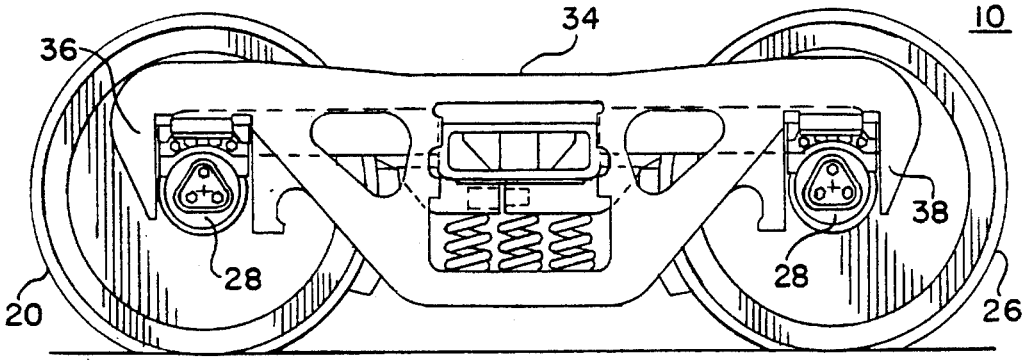
FIG. 2 is a side view of the truck and steering arm assembly of FIG. 2.
Figure 3:
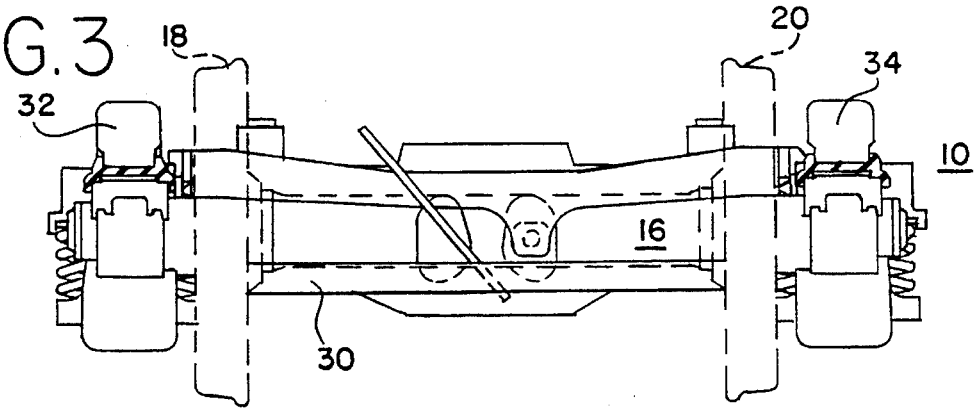
FIG. 3 is a front elevational view of the truck and steering assembly of FIG. 1.

In FIGS. 1–3, a railway truck 10 is illustrated in both plan and elevational views with first and second wheelsets 12 and 14, respectively, and a bolster 30, which wheel sets 12, 14 and bolster 30 are transversely coupled to the longitudinal direction of sideframes 32 and 34 at their approximate mid-length. Wheelset 12 includes an axle 16 with wheels 18 and 20 mounted at opposite axle ends 21,23. Wheelset 14 is similarly arranged with axle 22 and wheels 24,26 at axle ends 25,27. End cap and bearing assemblies 28 at the ends of each axle 16 and 22 provide for smooth rotation of wheelsets 12 and 14. In FIGS. 2 and 3, it is seen that each sideframe 32, 34 is secured to a respective end of bolster 30. Sideframe 34 includes forward pedestal 36 and rear pedestal 38 to receive bearing assemblies 28 of axles 16 and 22, respectively. Similarly, sideframe 32 has forward and rear pedestals 40, 42 on its opposite ends for bearing assemblies 28 of axles 16 and 22.

Truck 10 also includes a steering arm assembly 50, which has a first or forward subassembly 52 and a second or rear subassembly 54, which subassemblies are coupled to axles 16 and 22, respectively, at the axle ends 21, 23, 25 and 27, respectively. As front and rear steering-arm subassemblies 52 and 54 are similarly constructed, only rear steering-arm subassembly 54 will be described, with the description also applying to subassembly 52.

Assembly 50 has a thin, planar profile as shown in FIG. 5, and it is designed to fit into a relatively narrow space to perform a rigorous mechanical control function in a demanding environment. In FIG. 4, assembly 50 with subassemblies 52 and 54 is illustrated in an enlarged plan view, which subassemblies are generally centrally coupled at their cross-beams 60 by respective necks 53,55. Cross-beam 60 of subassembly 52 has first and second side arms 62 and 64, which said side arms 62 and 64 are similar and thus the description of side arm 62 will apply to side arm 64. Side arm 62 is coupled to cross-beam 60 at upper body portion 66, which extends from and is generally parallel to cross-beam 60, and has its end 67 in proximity to sideframe 32 in FIG. 1. Longitudinal segment or section 68 is coupled to end 67 and extends about normal to body portion 66 in the plane of assembly 50. A coupler device 70 at the extremity of each longitudinal segment 68 is provided for mounting and securing subassembly 54 and steering arm 50 to an axle 16 or 22, and sideframe 32 or 34.

Assembly 50 maintains wheel stability in railway truck 10, especially for heavy tonnage loads in curves and light tonnage loads operated at relatively high speeds. The relatively long, tapered longitudinal segment or side arm 68, is coupled to the wheel axle end 27, shown in FIG. 1, and is continuously subjected to all the random flexing from truck axle and wheel motions. Longitudinal segment 68 extends from body portion 66 at about a right angle to transverse axis 72, which is perpendicular to the longitudinal axis coincidental with cross-beam 60. Inner sidewall 74 of longitudinal segment 68 is tapered to a more narrow width from its junction or shoulder 76 at body portion 66 to approximately midway along the length of longitudinal segment 68.

Figure 7:
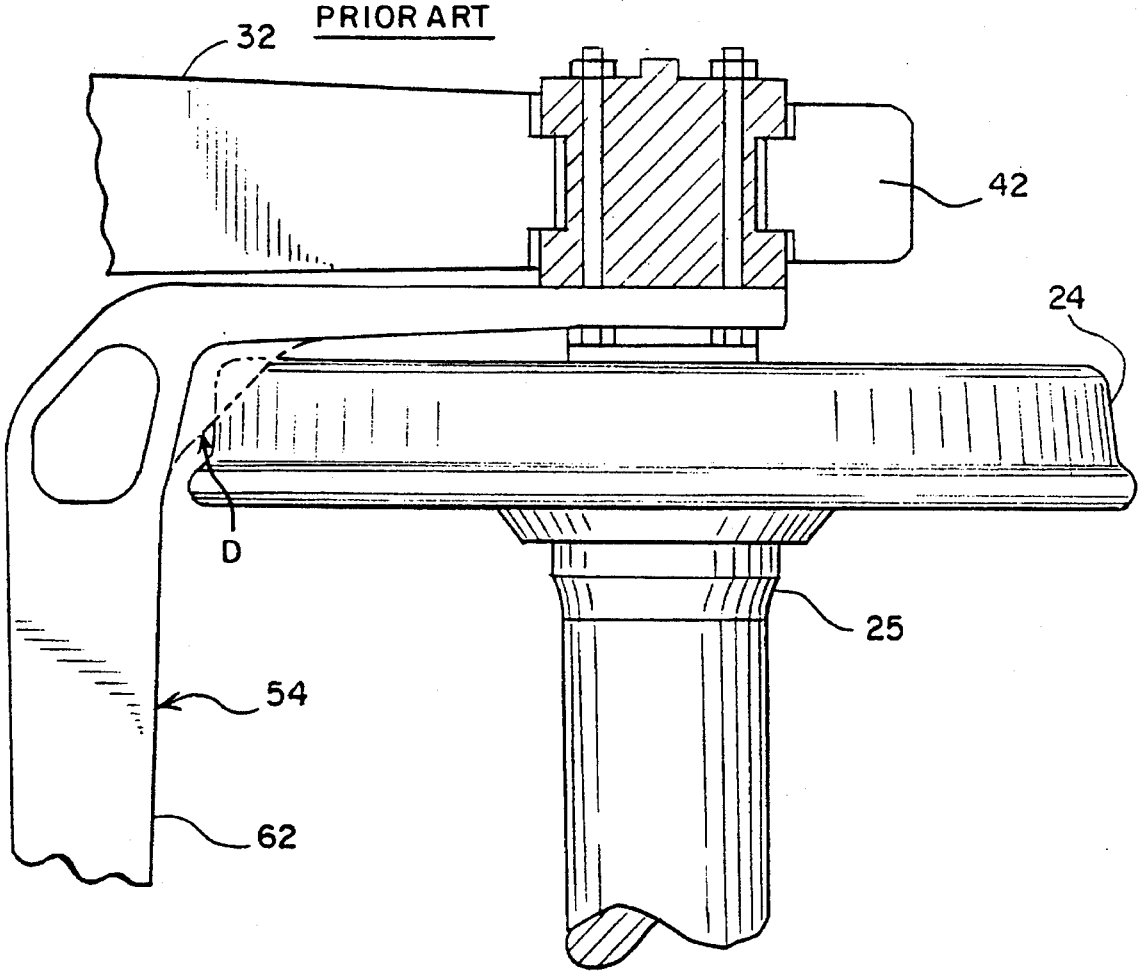
FIG. 7 PRIOR ART
FIG. 7 is an enlarged view of a prior art comer junction on the side arm, showing how a larger radius would interfere with the operation of the wheel.

Member joints like junction 76 are susceptible to flexural loading, especially where the long lever arm of segment 68 provides a mechanical advantage to promote fatigue cracking and fatigue failure. Shaping or rounding of comers has been utilized to strengthen such joints, where larger radii or materially thicker comers with more metallic mass overcomes or at least minimizes the potential for fatigue failure. In FIG. 4, the critical separation distance, "Y", is noted between the sidewalls of the respective longitudinal segments 68 of subassembly 52. The minimal clearance and spacing between the several components, such as wheel 18, junction 76, longitudinal segment 68 and body portion 66 is at a premium, as noted in FIGS. 1 and 4. The opportunity to provide shoulder 76 with either more mass or a greater corner radius is very small, as is best understood when viewing FIG. 7, where the dashed line "D" would represent using a prior art rounded corner with a larger radius. This figure illustrates the tolerance constraints between the steering arm and the wheel, making this alternative impossible to incorporate into actual use because the larger radius interferes with the operation of the wheel 24.

Longitudinal segment 68 suffers its largest flexural strain at cross-sectional width "X", which corresponds to junction 76,77, and which in prior art steering assemblies, was the location actually having the greatest cross-sectional width. Prior art steering arm assemblies either utilize a single-radiused comer at the junction 76 between body portion 66 and longitudinal segment 68 in order to avoid sharp notches as a means for lessening the strain there, or they provided a compound fillet to retain as much mass at the junction as possible in order to distribute the stresses over a larger area. The advantage of using a compound fillet is that it selectively provides and positions greater mass in the area of junction 76 without disrupting the spatial order of the components of either truck or steering arm, or encumbering operation of the wheels. The greater mass of the compound fillet structure was found to provide greater strength in the comer area compared to a comer using a single radius, however, the compound radius did not provide a smooth enough transition in cross sectional areas between the body portion and the longitudinal segment. This meant that the junction point was still an area of localized high stresses, which ultimately led to a reduction in the steering arm fatigue life. In addition, the earlier described problems associated with quality control in a foundry casting operation, proved impossible to maintain.

With those considerations in mind, it is important to understand that present invention uniquely reduces the stress accumulations at the junction 76 because an undercut radius provides a larger, and hence, smoother, transition in cross sectional areas between the side arm body portion and the longitudinal segment. Realizing that the undercut radius is removing metallic mass from a critical stress area, the stress concentration at the junction point is actually lowered, thereby increasing the fatigue strength at this location. Those in the art realize that the fatigue strength will be exponentially increased in direct relation to the amount of stress reduced. An enlarged view of junction 76 which incorporates the present invention between body portion 66 and longitudinal segment 68 is shown in FIG. 6. It is shown as an ovate-shaped depression in the side arm, which forms an ovately shaped surface which includes a first arc segment 80 with a first radius 82 and a second art segment 84 with a second radius 86. The larger arc segment 80 is in the form of an undercut, and this protects the spatial order of the components of the truck, steering arm, and wheels. The first radius also creates a first contact point "P1" with the inside surface 65 of body portion 66, where the ovately shaped surface of the undercut is joined to inside surface 65 in a smooth, tangential fashion. The first radius also creates a second contact point "P2" with the inside surface 74 of longitudinal segment 68. The intersection or joining of these two surfaces is made to transform into a smooth surface through the addition of the second radius 86. As seen, the second radius has a generally convex shape with respect to the inside surface 74 of longitudinal segment 68. Together, the dual-radius undercut appears as a continuous arc in the steering arm, thereby broadly satisfying the condition of compound radius at junction 76. Comparing FIG. 6 to FIG. 7, it is easy to see how the present invention differs from an inner junction merely provided with a larger corner radius D or even a compound fillet. From this illustrative comparison, it is seen that the undercut of the present invention vastly increases the surface area over which stresses can be distributed, while actually removing metallic mass in the junction.

In the preferred embodiment, the first and longer radius 82 is greater than two inches, yet less than 2.5 inches. Providing an undercut radius larger than that stated would structurally weaken the longitudinal segment and possibly cause fatigue cracking of the steering arm under normal operating conditions. Therefore, it is preferable that distance "X" of FIG. 4 be no less than 1.5 inches. The second and smaller radius 86 is preferably at least 1 inch, and not greater than 1.5 inches.

P The magnitude of the impact of actually reducing the cross-sectional thickness of an area already prone to fatigue cracking would appear to be contrary to expected engineering practices and therefore abnormal. However, this unique structural modification of mechanical assembly 50 produces both dramatic and unexpected consequences, even when compared to the improvements realized with a compound fillet. Structural stress tests on a steering arm assembly with an undercut radius have shown stress reductions between 35(%) percent and 51(%) percent from the stresses experienced by a compound fillet radius corner assembly at the same applied force. The tests were conducted on a single steering-arm Usection 52,54 mounted in a static test stand. This test-stand arrangement has been utilized for similar tests to analyze other steering arm assemblies, and has been found to provide satisfactory and consistent results indicative of test piece performance characteristics.

Furthermore, the larger undercut radius allows the side arm to be manufactured under less stringent standards where special quality assurances and finishing procedures are not required. This means that typical foundry practices can be utilized where the tolerances for surface defects, etc. will become realistic and where surface quality will not critically affect fatigue resistance performance.

While only a specific embodiment of the invention has been described and shown, it is apparent that various alternatives and modifications can be made thereto. Those skilled in the art will recognize that certain variations can be made in this illustrative embodiment. It is, therefore, the intention in the appended claims to cover all such modifications and alternatives as may fall within the true scope of the invention.

What is claimed:

1. In a steering arm assembly for lateral control of a railway car truck having a pivotal truck frame with a longitudinal axis, said truck frame including a first sideframe element and a second sideframe element, which first and second sideframe elements are about parallel, each said first and second sideframe element having a mid-region, a forward end and a rear end, a transverse frame element extending between said first and second sideframe element mid-regions, a pair of longitudinally spaced wheelsets, each said wheelset having an axle with spaced apart wheels fixed thereon, a wheelset mounted at each of said forward end and rear end of said sideframe elements, said steering arm assembly comprising:

a first U-shaped steering arm sub-assembly and a second U-shaped steering arm sub-assembly, said first and second steering arm sub-assemblies operable to provide transmission of steering forces from one of said wheelsets to the other of said wheelsets independent of the relative lateral position of the steering arm sub-assemblies and truck frame elements, each said first and second steering arm sub-assemblies having a respective cross beam with a first end and a second end, and each of said first and second steering arm sub-assemblies having a respective first side arm and a second side arm, one of said first and second side arms joined to a respective said cross-beam first end and the other of said first and second side arms joined to the other of said cross-beam first and second ends, each of said first and second side arms comprised of a respective body portion and a respective longitudinal segment, each said longitudinal segment extending generally from a respective said cross-beam for connection to a respective said axle, said longitudinal segment of each first and second sub-assembly sidearm generally parallel to said longitudinal segment of the other said first and second sub-assembly sidearm, each said longitudinal segment and said body portion having a respective inner surface and a respective outer surface, said inner surface of each said body portion disposed generally normal to a corresponding said inner surface of each said longitudinal segment and forming a respective inner junction on each of said sub-assembly sidearms, each said side arm inner junction comprising an undercut compound radius having a first radius in proximity to said body portion and a second radius in proximity to said longitudinal segment, said undercut compound radius defining a generally ovate depression and ovate surface in said sidearm wherein said ovate surface forms a first contact area with said body portion inner surface and a second contact area with said longitudinal segment inner surface, said ovate surface at said first contact area generally tangentially joined to said inner surface of said body portion and said ovate surface at said second contact area joined with said inner surface of said longitudinal segment at said second radius, said second radius having a generally convex configuration with respect to said inner surface of said longitudinal segment, said undercut compound radius providing a relatively smooth cross sectional transition between said body portion and said longitudinal portion, thereby reducing the stress intensity at said junction while maintaining clearance for said wheels and truck elements, said reduction in stress intensity resultantly corresponding to an increase in fatigue life of said sidearm.

2. In a steering arm assembly for a railway car truck as claimed in claim 1, wherein said first radius is greater than said second radius.

3. In a steering arm assembly for a railway car truck as claimed in claim 2, wherein said first radius defines a cross sectional area on said longitudinal segment that is smaller than a cross sectional area at any other point on said steering arm and on said longitudinal segment.

4. In a steering assembly for a railway car truck as claimed in claim 3, wherein said second radius defines a cross sectional area on said longitudinal segment which is greater then a cross sectional area at any other point on said longitudinal segment of said steering arm.

5. In a steering arm assembly for a railway car truck as claimed in claim 2, wherein said first radius and said second radius form a continuous arc in said steering arm.

6. In a steering arm assembly for a railway car truck as claimed in claim 5, wherein said ovate surface at said second contact area is tangential with said inner surface of said longitudinal segment at said second radius.

7. A side arm of a steering arm sub-assembly for securement to a sub-assembly cross-beam, comprised of:

a body portion; and a longitudinal segment, said longitudinal segment and said body portion each having an inner surface and an outer surface, said inner surface of said body portion disposed generally normal to said corresponding said inner surface of said longitudinal segment and forming an inner junction, said sidearm inner junction comprising an undercut radius having a first radius in proximity to said body portion and a second radius in proximity to said longitudinal segment, said undercut compound radius defining a generally ovate depression and ovate surface in said sidearm wherein said ovate surface forms a first contact point with said body portion and a second contact point with said longitudinal segment inner surface, said undercut compound radius providing a relatively smooth cross sectional transition between said body portion and said longitudinal portion, resultantly reducing the stress intensity at said junction such that the fatigue strength of said sidearm is increased.

* * * * *

UNITED STATES PATENT AND TRADEMARK OFFICE

CERTIFICATE OF CORRECTION

PATENT NO. : 5,461,987

DATED : October 31, 1995

INVENTOR(S) : Rami V. Nassar

It is certified that error appears in the above-indentified patent and that said Letters Patent is hereby corrected as shown below:

The title page, showing an illustrative figure, should be deleted and substitute therefor the attached title page.

In the drawings, sheet 2, Figure 6, reference numerals 65, 74, P1, and P2 should be applied to the Figure as shown on the attached page.

Signed and Sealed this

Twenty-ninth Day of October 1996

*Attest:*

Bruce Lehman

BRUCE LEHMAN

*Attesting Officer*

*Commissioner of Patents and Trademarks*

United States Patent [19]

Nassar

[11] Patent Number: 5,461,987

[45] Date of Patent: Oct. 31, 1995

[54] SIDE ARM STRUCTURE OF A STEERING ARM ASSEMBLY HAVING AN UNDERCUT RADIUS

[75] Inventor: Rami V. Nassar, Chicago, Ill.

[73] Assignee: AMSTED Industries Incorporated, Chicago, Ill.

[21] Appl. No.: 276,563

[22] Filed: Jul. 18, 1994

[51] Int. Cl.[6] ..... B61F 5/50

[52] U.S. Cl. ..... 105/167; 105/168

[58] Field of Search ..... 105/165, 167, 105/168, 463, 1; 213/100, 152

[56] References Cited

U.S. PATENT DOCUMENTS

| | | | |
|---|---|---|---|
| 4,131,069 | 12/1978 | List | 105/168 |
| 4,889,054 | 12/1989 | List | 105/167 |
| 4,976,362 | 12/1990 | Kaufhold | 213/152 |
| 5,224,428 | 7/1993 | Wronkiewicz | 105/167 |

OTHER PUBLICATIONS

*"Stress Concentration Factors"* by R. E. Peterson, Willy & Sons, New York, 1974; pp. 83–86.

*Primary Examiner*—Robert J. Oberleitner
*Assistant Examiner*—Clifford T. Bartz
*Attorney, Agent, or Firm*—Edward J. Brosius; F. S. Gregorczyk; Thomas J. Schab

[57] ABSTRACT

A steering arm assembly for a railway truck has an undercut compound radius between the body portion and the longitudinal segment on of each side arm in order to decrease the stress intensity at this location, which resultantly provides increased flexural strength to the assembly while maintaining the clearance between the steering arm and truck components.

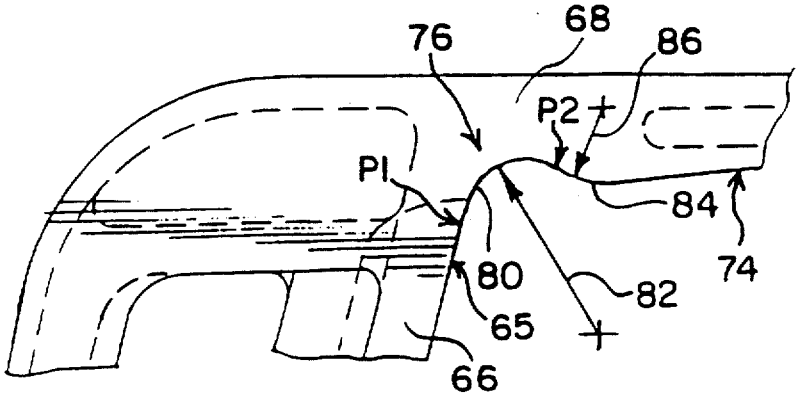

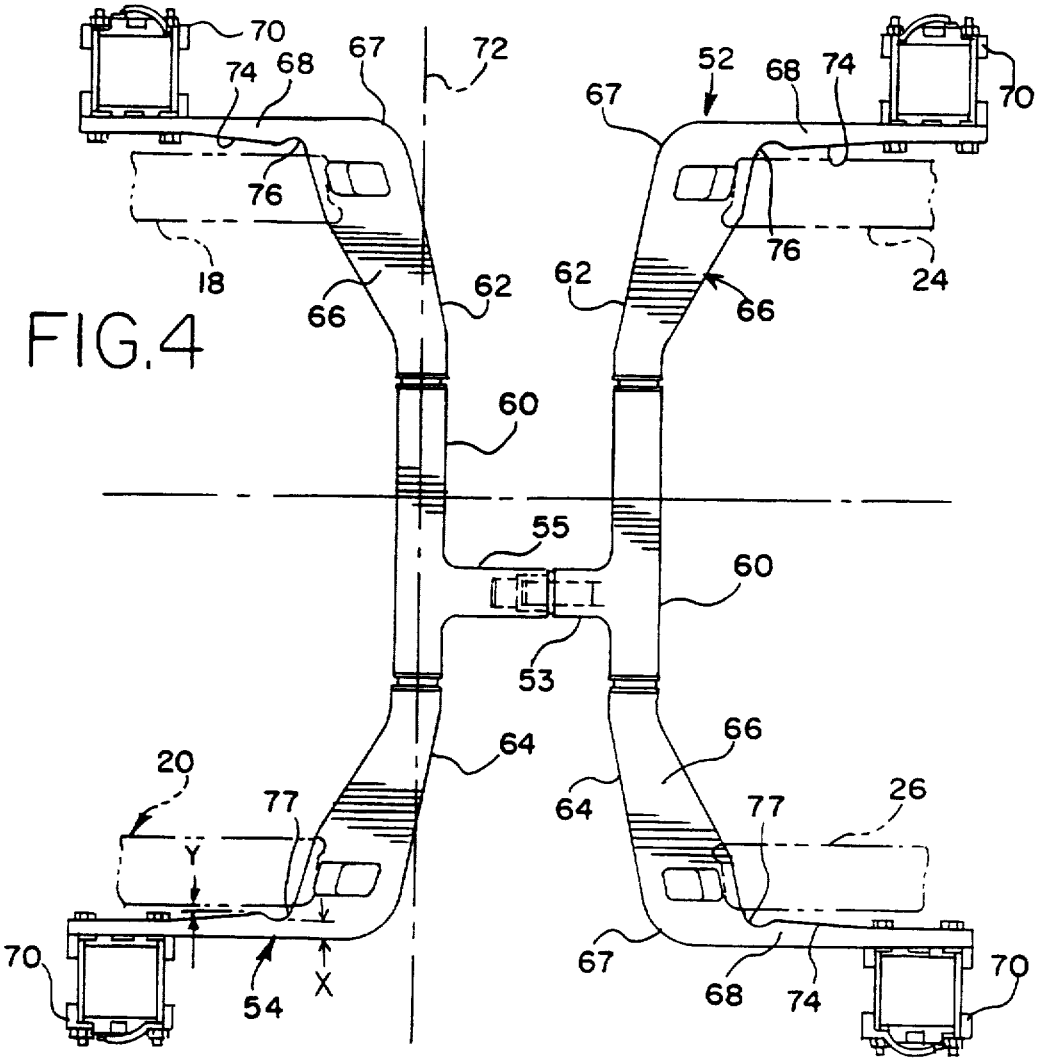
FIG.4
FIG.5
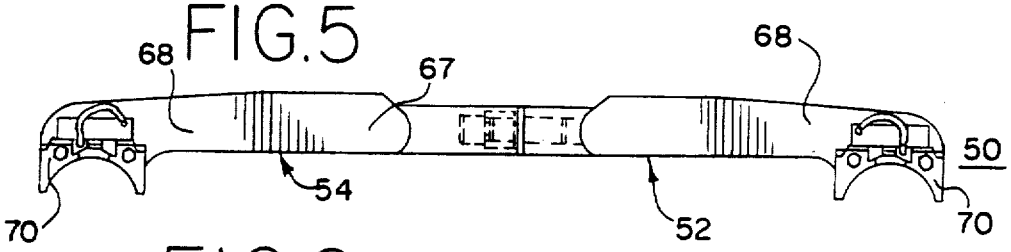
FIG.6
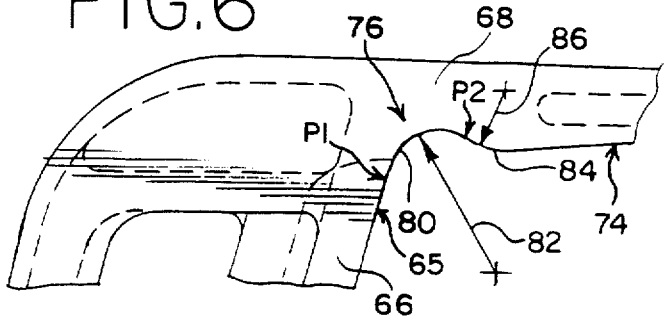

7 Claims, 3 Drawing Sheets